US007887471B2

(12) United States Patent
McSorley

(10) Patent No.: US 7,887,471 B2
(45) Date of Patent: Feb. 15, 2011

(54) NEUROMUSCULAR TRAINING APPARATUS AND METHOD OF USE

(76) Inventor: Tyrone G. McSorley, 2897 Shadowbrook La., San Luis Obispo, CA (US) 93401

( * ) Notice: Subject to any disclaimer, the term of this patent is extended or adjusted under 35 U.S.C. 154(b) by 0 days.

(21) Appl. No.: 12/566,868

(22) Filed: Sep. 25, 2009

(65) Prior Publication Data

US 2010/0130336 A1 May 27, 2010

Related U.S. Application Data

(63) Continuation-in-part of application No. 12/323,377, filed on Nov. 25, 2008.

(51) Int. Cl.
*A63B 21/00* (2006.01)
*A63B 26/00* (2006.01)

(52) U.S. Cl. ..... 482/138; 482/136; 482/78

(58) Field of Classification Search ..... 482/38–39, 482/48, 69, 100–103, 138, 908
See application file for complete search history.

(56) References Cited

U.S. PATENT DOCUMENTS 1,472,906 A 11/1923 Gorrell
2,739,783 A * 3/1956 Pentecost ..... 254/124
2,871,915 A * 2/1959 Hogan ..... 482/69
3,013,806 A * 12/1961 Boyd ..... 280/78
3,083,037 A * 3/1963 Gordon et al. ..... 280/206
3,384,332 A * 5/1968 Fenner et al. ..... 248/165
3,606,316 A 9/1971 Krewer
3,675,259 A * 7/1972 Gilchrist ..... 441/78
3,747,956 A * 7/1973 Heberlein ..... 280/206
3,778,052 A * 12/1973 Andow et al. ..... 280/87.041
3,782,719 A * 1/1974 Kuhlman ..... 482/48
3,871,646 A 3/1975 Slack
4,149,713 A * 4/1979 McLeod ..... 482/101
4,302,006 A * 11/1981 Johnson ..... 482/78
4,389,047 A * 6/1983 Hall ..... 482/2
4,458,895 A * 7/1984 Turcotte ..... 482/78
4,640,268 A * 2/1987 Roberts ..... 601/24
4,724,827 A * 2/1988 Schenck ..... 601/40
4,973,050 A * 11/1990 Santoro et al. ..... 482/102
5,018,725 A * 5/1991 Cook ..... 482/103
5,102,122 A * 4/1992 Piane et al. ..... 482/133
5,303,696 A 4/1994 Boice (Continued)

OTHER PUBLICATIONS

Sammons Preston Professional Rehab Catalog 2006 pp. 230, 233-237, 245, 263, 266, 270.

*Primary Examiner*—Rinaldi I Rada
*Assistant Examiner*—Robert F Long
(74) *Attorney, Agent, or Firm*—Philip A Steiner, Esq.

(57) ABSTRACT

Neuromuscular training apparatus configured to maintain a body unit in a suitable geometry for performing neuromuscular training therapy or athletic training. The neuromuscular training apparatus comprises a center support member and a pair of transverse support members coupled to opposing ends of the center support member in a parallel spaced relationship. A plurality of arcuate members span the spaced relationship between the transverse support members. The arcuate members are axially repositionable about a common vertical axis which parallels the center support member. Each arcuate member is configured to maintain a radial element in a suitable geometry with the body unit for performing the neuromuscular training by providing a bias force, movement restriction or inhibition to a range of movement of the body unit.

22 Claims, 10 Drawing Sheets

U.S. PATENT DOCUMENTS 5,403,253 A * 4/1995 Gaylord ..... 482/43
5,403,270 A * 4/1995 Schipper ..... 602/36
5,441,255 A * 8/1995 Verbick ..... 473/55
5,445,582 A 8/1995 Brown
5,472,407 A 12/1995 Schenck
5,556,359 A 9/1996 Clementi
5,569,138 A * 10/1996 Wang et al. ..... 482/130
5,626,540 A * 5/1997 Hall ..... 482/69
5,662,560 A * 9/1997 Svendsen et al. ..... 482/69
5,667,461 A * 9/1997 Hall ..... 482/69
5,738,613 A 4/1998 Clayton
5,788,606 A * 8/1998 Rich ..... 482/27
5,820,577 A 10/1998 Taylor
5,846,134 A * 12/1998 Latypov ..... 463/46
5,885,190 A * 3/1999 Reiter ..... 482/69
6,036,622 A * 3/2000 Gordon ..... 482/51
6,099,438 A 8/2000 Dawson
6,102,836 A * 8/2000 Person ..... 482/103
6,146,315 A * 11/2000 Schonenberger ..... 482/69
6,148,580 A * 11/2000 Weir ..... 52/651.1
6,165,110 A * 12/2000 Gajda ..... 482/102
6,179,751 B1 1/2001 Clears
6,213,918 B1 4/2001 Rogers, Jr.
6,280,361 B1 * 8/2001 Harvey et al. ..... 482/8
6,289,534 B1 * 9/2001 Hakamiun et al. ..... 5/89.1
6,500,097 B1 * 12/2002 Hall ..... 482/54
6,551,216 B2 * 4/2003 Rennex ..... 482/35
6,554,747 B1 * 4/2003 Rempe ..... 482/38
6,612,845 B1 * 9/2003 Macri et al. ..... 434/247
6,652,426 B2 * 11/2003 Carter et al. ..... 482/100
6,685,600 B1 * 2/2004 Ullman ..... 482/103
6,705,976 B1 * 3/2004 Piane, Jr. ..... 482/103
6,740,051 B2 5/2004 Hepburn et al.
6,942,487 B2 * 9/2005 Corbalis ..... 434/247
6,986,728 B2 1/2006 Kasun
7,048,677 B2 * 5/2006 Mackert et al. ..... 482/102
7,104,926 B2 * 9/2006 Carlson ..... 482/10
7,128,695 B2 * 10/2006 Panatta ..... 482/100
7,160,226 B2 1/2007 Liu
7,172,538 B2 * 2/2007 Keiser ..... 482/140
7,235,028 B2 6/2007 Liao
7,238,116 B1 * 7/2007 Sulzener ..... 473/259
7,288,051 B1 10/2007 Phillips
7,335,141 B2 * 2/2008 Piane, Jr. ..... 482/99
7,553,262 B2 * 6/2009 Piane, Jr. ..... 482/99
7,568,715 B2 * 8/2009 Cooney ..... 280/206
7,625,320 B2 * 12/2009 Wehrell ..... 482/92
7,651,450 B2 * 1/2010 Wehrell ..... 482/124
7,666,126 B2 * 2/2010 Rempe ..... 482/143
7,758,479 B2 * 7/2010 Husted et al. ..... 482/100
2003/0027694 A1 * 2/2003 Harrison ..... 482/94
2003/0105416 A1 6/2003 Hepburn et al.
2003/0114281 A1 * 6/2003 Mackert et al. ..... 482/123
2006/0160677 A1 * 7/2006 Piane, Jr. ..... 482/101
2006/0178247 A1 8/2006 Liu
2006/0247102 A1 11/2006 Kupferman
2007/0129216 A1 6/2007 Ott et al.
2008/0020912 A1 * 1/2008 Dalebout et al. ..... 482/129
2010/0130330 A1 * 5/2010 McSorley ..... 482/48

* cited by examiner

NEUROMUSCULAR TRAINING APPARATUS AND METHOD OF USE

CROSS-REFERENCE TO RELATED APPLICATIONS

This application is a continuation-in-part and takes priority from co-pending utility application Ser. No. 12/323,377, filed on Nov. 25, 2008 to the instant inventor; application Ser. No. 12/323,377 is hereby incorporated by reference as if fully set forth herein in its entirety.

RELEVENT INVENTIVE FIELD

The various exemplary embodiments relate generally to a physical therapy and athletic training apparatus and more specifically to an apparatus for providing physical therapy, occupational therapy and/or athletic training to a body unit.

BACKGROUND

Injury and/or disease which affects the muscles, tendons, ligaments, cartilaginous tissues, fasciae, joints and/or bones of the body can result in disability if effective treatments are not performed in a timely manner due to scar tissue formation, loss of muscle integrity, calcification of bone joints, and/or degradation of cartilaginous or tendon tissues. Traditional treatments, particularly post trauma and/or post surgery are generally limited to treating a defined joint or muscle group without consideration of supporting or secondary joints or muscle groups which assist the subject in various movements or activities. For example, an injury to a shoulder joint involves musculoskeletal elements of the thorax, proximal extremity and spinal vertebra. To provide effective therapy and rehabilitation of the exemplary shoulder injury typically requires multiple pieces of equipment in order to rehabilitate the muscle groups, fascia, connective tissue and joints which are used to provide proper movement of the afflicted shoulder and proximate extremity.

Current research in related areas of kinesiology and proprioceptive neuromuscular facilitation have shown that the brain does not typically isolate a particular muscle group to elicit movement. Rather, the brain typically uses neuromuscular feedback to cause a particular movement of a body unit which resembles an already learned movement based on the brain's ability to determine where a particular body part is in space (proprioception) and sensation that the body part has moved (kinesthesia).

Proprioception can be improved through defined body unit movements. For example, juggling trains reaction time, spatial location, and efficient movement. Standing on a wobble board or balance board is often used to retrain or increase proprioceptive abilities, particularly as physical therapy for ankle or knee injuries or an the exercise ball which works on balancing muscle contractions of the abdominal and back muscles.

Kinesthesia is important for gaining muscle memory and hand-eye coordination, both of which are enhanced by repetitive training. For example, the ability to swing a golf club or to catch a baseball requires a finely-tuned sense of the position of the joints (proprioception) and determining whether the joints have been moved into the proper position (kinesthesia) to accomplished a learned movement. These senses become automatic through repetitive training to enable a subject to concentrate on other aspects of performance, such as maintaining balance. During any complex movement, the musculoskeletal system undergoes a wide variety of muscular contractions which exerts multiple forces on the skeletal system throughout a range of motion.

Since the musculoskeletal system undergoes multiple forces during movement, there is a need in the relevant art to provide an apparatus which facilitates effective treatment and/or neuromuscular training of a subject. The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

SUMMARY

The various exemplary embodiments disclosed herein address a long felt need in physical therapy for an apparatus which may be used to provide effective therapy regimens to a subject without requiring a multitude of separate apparatuses, the ability to focus recuperative or training exercises on specific muscles, joints, bones, cartilaginous tissues, ligaments and/or tendons of a body unit; and which provides flexible geometries to effectively and comfortably treat subjects as part of the effective therapy regimen. For purposes of this specification, a body unit is a grouping of related bones, joints, muscles, cartilaginous tissues, fascia, ligaments and/or tendons which are used to provide a range of movement, agility, endurance, balance, flexibility, coordination, power, strength and/or stability of a subject.

For purposes of this specification, neuromuscular training exerts forces on the body unit to restore or improve range of motion, and isolation/integration of various muscle groups, bones, joints and connective tissues. The goal of neuromuscular training is to develop specific neurological responses to muscle groups responsible for controlling static and dynamic postures, body positioning, righting and equilibrium reflexes, maintenance of center(s) of gravity and coordinating movement of body units.

In an exemplary embodiment, a neuromuscular training apparatus is configurable for many applications, including but not limited to preventative care, rehabilitation and/or athletic training. As non-limiting examples, rehabilitating a hip and leg by simulating climbing and/or descending stair steps; rehabilitating a back or shoulder injury by raising an object overhead as if to place the object on a shelf; simulating the proper grip, body position and/or stance for use of a particular piece of sporting equipment such as a baseball, and/or a baseball bat, a football, a golf club, a tennis racket, skis, surfboard, etc.

In an exemplary embodiment, the neuromuscular training apparatus is comprised of a fixture. The fixture includes a number of repositionable arcuate members which are pivotally coupled to the fixture. The repositionable arcuate members are configured to maintain a number of radial elements in a suitable geometry for exerting a bias force on a body unit. In use, at least some of the radial elements are coupled with one or more of the arcuate members and with the body unit to exert the bias force to oppose or inhibit movement of the body unit. Other radial elements may be used to assist movement of the body unit in a predetermined range of motion. Still other radial elements are configured to retain the body unit in the suitable geometry so that the bias force exerted on the body unit remains focused on the body unit throughout a predetermined range of motion.

In an exemplary embodiment, the radial elements are coupled to the arcuate members with connecting members. Each of the connecting members is longitudinally and axially repositionable when coupled with an arcuate member and includes means for connecting and maintaining an end of one or more radial members in the suitable geometry with one or more of the arcuate members. The means may include any of a hook, a clamp, a latch, a hook and loop fastener, a buckle, a tie, a knot and a mechanical fastener.

In an exemplary embodiment, the fixture is comprised of a center support member and first and second transverse members coupled to ends of the center support member roughly resembling a squared "C" or sideways "U".

When configured for providing neuromuscular training, the first and second transverse members are aligned in a parallel spaced relationship with one another. Each of the arcuate members longitudinal span between the two transverse members in a repositionable hemispherical orientation. In an exemplary embodiment, the first and second transverse members are pivotally coupled in a cantilevered arrangement with the center support member which allows the fixture to fold into a compact space for storage.

In an embodiment, first and second locking assemblies are provided which repositionably maintain first and second ends of the repositionable arcuate members in the suitable geometry. The first and second locking assemblies are repositionably coupled to the first and second transverse members which allows positioning of the arcuate members about a central longitudinal axis which parallels the center support member. In an exemplary embodiment, each arcuate member forms a hemispherical frame which spans the parallel spaced relationship between the first and second locking assemblies.

In an exemplary embodiment, the first and second locking assemblies are slidably coupled along long axes of the first and second transverse members. Retention of the locking assemblies at a given position along the long axis of the transverse members may be accomplished using a pin/aperture arrangement or clamping assembly.

In an exemplary embodiment, index markings may be provided on any of the locking assemblies and/or arcuate members for setting and/or resetting of various suitable geometries for providing neuromuscular training.

In an exemplary embodiment, the radial elements are coupled to the plurality of arcuate members with connecting members. Each of the connecting members includes means for connecting and maintaining an end of one or more radial members in the suitable geometry with one of the plurality of arcuate members and the body unit.

In an exemplary embodiment, a sling is coupled to an end of one or more radial elements opposite the connecting member(s). Each sling is generally dimensioned to circumferentially encompass some or all of the body unit in which the bias force is to be exerted. In an exemplary embodiment, the bias force is generally exerted at a angle perpendicular with a joint, a muscle, a muscle group, a tendon, fascia, ligament, cartilaginous tissue and/or combinations of joints, muscles, muscle groups, tendons, fasciae, ligaments and cartilaginous tissues. In another embodiment, the bias force is multi-axis and applied as a vector sum to the body unit.

In an exemplary embodiment, an object is provided which contacts the body unit at least during exertion of the bias force. The object may be a table, a chair, a sloped plane, stair-steps, a piece of sporting equipment, or a box. In an exemplary embodiment, the table is configured as a multi-axis tilt table or pivot up or down as required to obtain a particular suitable geometry.

In summary, the various exemplary embodiments disclosed herein address a long felt need in the art to provide a neuromuscular training apparatus suitable for physical therapy, occupational therapy and athletic training.

BRIEF DESCRIPTION OF DRAWINGS

The features and advantages of the various exemplary embodiments will become apparent from the following detailed description when considered in conjunction with the accompanying drawings. Where possible, the same reference numerals and characters are used to denote like features, elements, components or portions of the inventive embodiments. It is intended that changes and modifications can be made to the described exemplary embodiments without departing from the true scope and spirit of the inventive embodiments as is defined by the claims.

DETAILED DESCRIPTION

Effective treatment of injuries and/or diseases which affect locomotion, movement or range of movement of the body unit require placing the body unit in specific geometries in order to properly focus a therapy regimen on specific muscles, ligaments, tendons, joints, cartilaginous tissues, fascia and/or bones. Analogously, physical training of proper body positions or stances for using athletic equipment is advantageous in order to maximize neuromuscular training. Neuromuscular training integrates positioning of the body unit with neurological feedback in order to rehabilitate or establish a programmed movement. The ability to provide multi-axis bias resistance and/or assistance in a full range of motion in a single apparatus is a significant advantage over the multiple apparatuses available in the relevant art.

This multi-axis ability allows a medical professional or athletic trainer to more closely simulate actual motions for gait, balance, work, and/or athletic activities. With multi-axis, simultaneous resistance, the brain and nervous system are trained, or re-trained, to perform muscular contractions/co-contractions, while working additional muscle groups not engaged by traditional gym type exercise machines. This combination of muscular contractions/co-contractions allows simple movements to be performed initially and increased over time in complexity and tension to facilitate an almost unlimited combination of muscular contractions/co-contractions of both primary and supportive muscle groups associated with a particular body unit.

As such, muscles can actually exhibit greater excitation if exercised in combinations with other related muscle groups and movements which have already been learned. This has been shown for example in the quadriceps, with dorsi-flexion of the ankle, supination of the forearm and external rotators of the shoulder.

Multiple muscle groups contracting simultaneously establishes improved combinations of programmed moments and may be used to up-train (i.e., increase contraction) of certain muscle groups while down-training other muscle groups (i.e., decrease contraction) for therapeutic purposes or to improve athletic performance. A balance is required which programs the proprioceptive (joint awareness in space) of the brain, plus the tendon, capsule, ligaments of both the stabilizing and moving joints. Pre-programming the nervous system for proper muscle timing and contraction/co-contraction of core stabilizers is a significant advantage of the neuromuscular training apparatus.

The various exemplary embodiments described below address a long felt need in sports medicine, physical and/or occupational therapy to provide effective treatments by specifically isolating muscles, fascia, tendons, ligaments, cartilaginous tissues, bones and/or joints of the body unit to improve or regain a subject's mobility or improve the subject's athletic performance.

Figure 1:
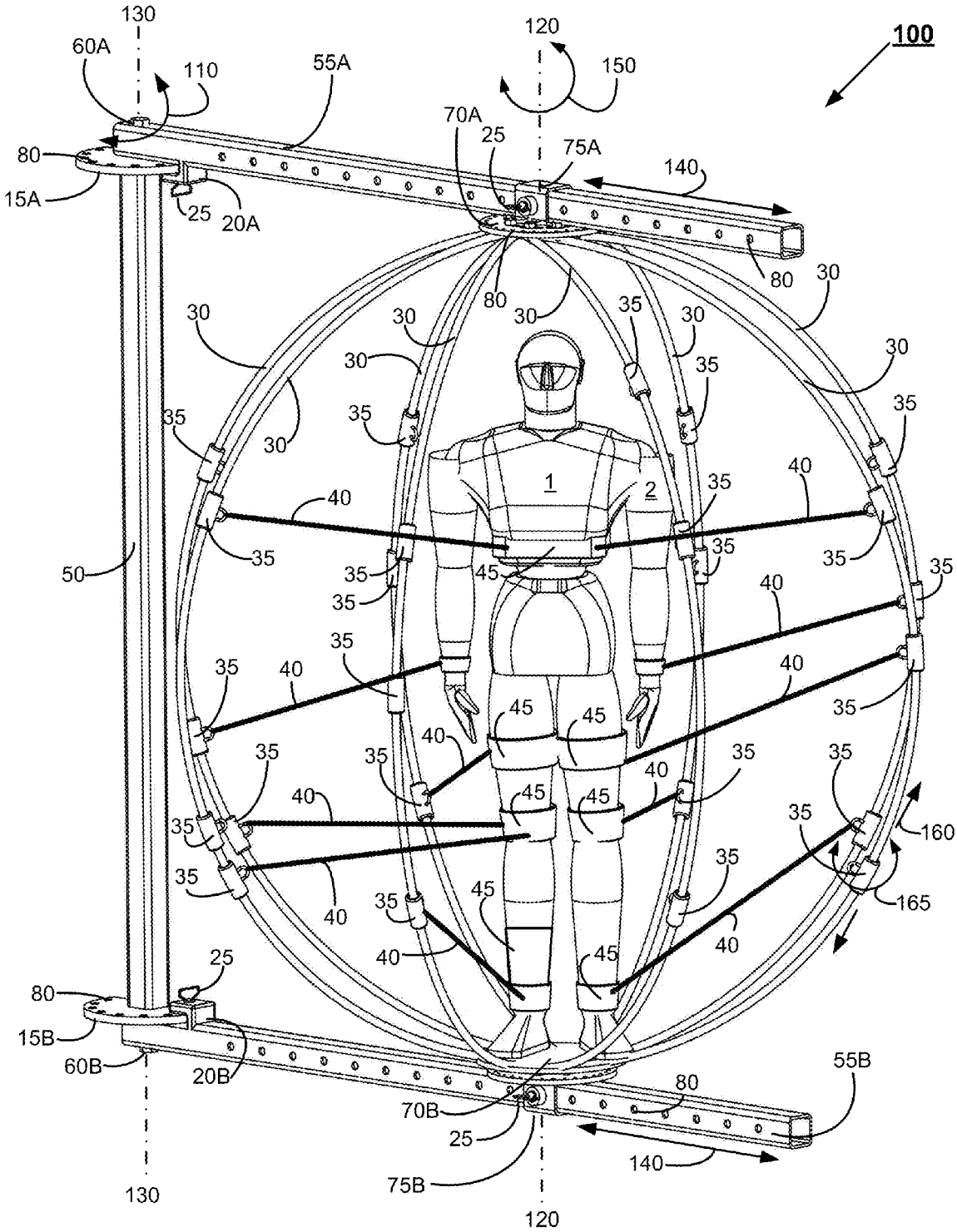
FIG. 1—depicts an isometric view of a neuromuscular training apparatus in accordance with an exemplary embodiment.

Referring to FIG. 1, an isometric view of an neuromuscular training apparatus 100 in accordance with an exemplary embodiment is depicted. In an exemplary embodiment, the neuromuscular training apparatus 100 is provided with a fixture 50, 55A, 55B. The fixture further includes a plurality of pivotally coupled arcuate members 30 which when positioned for performing neurological integration, the arcuate members 30 form a generally spherical space configurable to surround some or all of a body unit 2 of a subject 1. In an exemplary embodiment, the neuromuscular training apparatus 100 is comprised of a center support member 50 and first and second transverse members 55A, 55B. The first and second transverse members 55A, 55B are pivotally coupled 110 to opposite ends of the center support member 50 in a cantilevered arrangement to form a structure which generally resembles a squared "C" or sideways "U". Axially opposing first and second axles 60A, 60B are provided at ends of the center support member 50 which pivotally join the first and second transverse members 55A, 55B with the center support member 50. The first and second axles 60A, 60B allow the first and second transverse members 55A, 55B to axially pivot 110 about a longitudinal centerline 130 of the center support member 50. Additionally, the first and second axles allow the first and second transverse members 55A, 55B to pivot for storage purposes.

In an exemplary embodiment, when in a position for providing neuromuscular training, the first and second transverse members 55A, 55B are aligned in a parallel spaced relationship with one another. Each of the arcuate members 30 longitudinally span between the two transverse members 55A, 55B in a repositionable 120 hemispherical orientation. The first and second transverse members 55A, 55B are maintained in a suitable geometry with first and second flange members 15A, 15B. The first and second flange members 15A, 15B are coupled to opposite ends of the center support member 50 in close proximity to an intersection of the first and second transverse members 55A, 55B and the center support member 50. The first and second flange members 15A, 15B include a plurality of apertures 80 drilled perpendicularly through predominate faces of the flanges 15A, 15B. Each of the apertures 80 are dimensioned to axially receive locking pins 25 which are inserted into a particular aperture 80 to maintain the first and second transverse members 55A, 55B in a suitable geometry to perform neuromuscular training. One skilled in the art will appreciate that a threaded hand knob or other mechanical device may used as well.

In an exemplary embodiment, the center support member 50 and first and second transverse members 55A, 55B are constructed from a metal rod or tube, a high impact plastic, a fiberglass/epoxy mixture, graphite composites or polycarbonate material. In an exemplary embodiment, the center support member 50 and first and second transverse members 55A, 55B may be made to telescope (not shown) in order to reduce the volume of space required for storage and/or to provide custom geometries for performing neuromuscular training Likewise, the arcuate members 30 may be constructed from telescoping materials as well (not shown.)

In an exemplary embodiment, the locking pins 25 are attached to proximal ends of the first and second transverse members 55A, 55B with brackets 20A, 20B. The brackets 20A, 20B are affixed to proximal ends of the first and second transverse members 55A, 55B such that parallel surfaces of the first and second flange members 15A, 15B are encompassed on opposing sides by parallel surfaces of the first and second brackets 20A, 20B and the first and second transverse members 55A, 55B. The locking pins 25 are mounted perpendicularly to the first and second brackets 20A, 20B and aligned to engage the apertures 80 drilled into the predominate faces of the first and second flange members 15A, 15B; this arrangement maintains the first and second transverse members 55A, 55B in the suitable geometry to perform neuromuscular training.

In an exemplary embodiment, the arcuate members 30 are repositionably coupled with the first and second transverse members 55A, 55B with first and second locking assemblies 70A, 70B. The arcuate members 30 are substantially identical in shape and dimensions and may be constructed from a tubular or solid rod-like material. For example, steel, aluminum, a high impact plastic, a fiberglass/epoxy mixture, graphite composites or a polycarbonate material. In this embodiment, each of the arcuate members 30 may be individually positioned about a longitudinal centerline 120 which intersects the first and second locking assemblies 70A, 70B. The arcuate members 30 are configured to maintain radial elements 55 in the suitable geometry to perform neuromuscular training of the subject 1. The arcuate members 30 when positioned to perform neuromuscular training provides a spherical framework for coupling of radial elements 40 with the body unit 2. In addition, the arcuate members 30 provide structural integrity in conjunction with the first and second transverse members 55A, 55B and center support member 50 for supporting static and dynamic loads generated by the subject 1 and/or radial elements 55 during performance of neuromuscular training. While illustrated as rods or tubes in FIG. 1, the arcuate members 30 may also be formed from elongated strips as well. In an exemplary embodiment, the arcuate members 30 include indexing marks 105 (FIG. 1A) to allow for setting and/or resetting of suitable geometries.

In an exemplary embodiment, the arcuate members 30 are concentrically arranged about the common vertical axis 120, so that each arcuate member 45 may be positioned into a common alignment which reduces the cross section of the neuromuscular training apparatus 100 for storage. Analogously, the first and second transverse members 55A, 55B may be repositioned 110 from the outwardly projecting orientation shown in FIG. 1 to a side projecting orientation shown in FIG. 1B for storage purposes. In an alternate embodiment, the center support member 50 and/or the first and second transverse members 55A, 55B may be made to telescope to further reduce storage space requirements. The number of arcuate members 30 which are provided with the neuromuscular training apparatus 100 is not critical. Typically, two to eight arcuate members 30 are installed with the neuromuscular training apparatus 100 depending on the particular suitable geometry sought.

The first and second locking assemblies 70A, 70B are configured to retain each of the arcuate members 30 in the suitable geometry to perform neuromuscular training. In an exemplary embodiment, the first and second locking assemblies 70A, 70B are longitudinally repositionable 140 about the long axes of the first and second transverse members 55A, 55B. In this embodiment, the first and second locking assemblies 70A, 70B are provided with locking pins 25 which are configured to engage apertures 80 included in the first and second transverse members 55A, 55B. The locking pins 25 are used to maintain the first and second locking assemblies 70A, 70B in the suitable geometry for performing neuromuscular training. The locking pins 25 are incorporated with slide brackets 75A, 75B. The slide brackets are dimensioned to slidably encompass the first and second transverse members 55A, 55B. Alternate means of repositionably coupling the first and second locking assemblies 70A, 70B to the first and second transverse members 55A, 55B include but are not limited to clamping assemblies (not shown) and ratchet assemblies (not shown). Additional details concerning the first and second locking assemblies 70A, 70B are provided below in the discussion accompanying FIG. 1A below.

The radial elements 55 are generally configured to provide a bias force in opposition to movement of the body unit. Typically, the bias force is exerted at a perpendicular angle perpendicular to movement of a joint, muscle, muscle group, tendon, fascia and/or ligament associated with a body unit. However, exertion of the bias force may also be used to engage other portions of the body unit 2 which otherwise influences any of agility, endurance, balance, flexibility, coordination, power and/or strength of the body unit 2.

In an exemplary embodiment, which when used to generate a bias force, some of the radial elements 55 are constructed from elastomeric materials such as synthetic rubber, latex, natural rubber and like polymers having resilient or elastomeric properties. The lengths of the radial elements 55 and amount of tension to be provided during neuromuscular training apparatus are selected by a therapist or trainer. Thus, various lengths, and/or tensions of the radial elements 55 are used in the course of treatment of the subject. By way of example and not limitation, various sizes of latex tubing, rubber bands, springs and like materials may be used to customize the amount of tension generated by the radial elements 55 during neuromuscular training.

In an exemplary embodiment, when the radial elements 55 are used to provide inhibition of movement, the radial elements 55 may be constructed from rigid or semi-rigid materials such as polyvinyl chloride (PVC), acrylonitrile butadiene styrene (ABS), fiberglass, fiberglass/epoxy, acrylic, polycarbonate, graphite composites or any other suitable material configured in a rod shape and longitudinally dimensioned to span the distance between an arcuate member 45 and a body unit 2 of the subject. In an exemplary embodiment, when the radial elements 55 are used to provide restraint of movement, the radial elements 55 are constructed from a generally non-resilient limp material such as nylon, Dacron, Kevlar, cotton or any other suitable cordlike material dimensioned to span the distance between an arcuate member 45 and a body unit 2 of the subject 1.

In an exemplary embodiment, the radial elements 55 are coupled to the subject 1 with slings 45. The slings 45 are typically dimensioned to encompass a portion of the body unit 2 in which neuromuscular training is to be performed but not exclusively so. The slings 45 typically are provided as bands configured to attach to the radial elements 55. Alternate embodiments of the slings 45 include vests, belts, boots, gloves and sleeves which may also be used in order to focus the bias force(s) on a particular body unit 2. The slings 45 are typically constructed of fabric materials which are comfortable for the subject 1 to wear on a particular body unit 2. The slings 45 may also incorporate padding and other materials in order to obtain a particular suitable geometry for performing neuromuscular training and for coupling the radial elements to the slings 45.

The radial elements 40 are coupled to the arcuate members 30 with connecting members 35. Each connecting member 35 is longitudinally 160 and axially 165 repositionable about the arcuate members 30. To minimize obscuring other features shown in FIG. 1, only one of the connecting members 35 is shown being longitudinally 160 and/or axially repositionable 165 about the arcuate members 30. One skilled in the art will appreciate that each of the connecting members 35 may be so configured.

The radial elements 40 are coupled with the connecting members 35 with any suitable means. By way of example and not limitation the suitable means for connecting the radial elements 40 with the connecting members 35 includes hooks, clamps, hook and loop fasteners, loops, buckles, ties, knots and mechanical fasteners. In an exemplary embodiment, the suitable means is integrated into the connecting members 35. The neuromuscular training apparatus 100 may be scaled in dimensions to provide neuromuscular training of individual body units alone or made to accommodate an adult subject 1 and various objects within a training space encompassed by the arcuate members 30. In an exemplary embodiment, lateral cross members (not shown) may be slidably coupled to the first and second transverse members 55A, 55B. These additional lateral cross members may be used to expand the volume of therapy space defined by the arcuate members. In this exemplary embodiment, the lateral cross members (not shown) would be aligned perpendicular to the long axes of the first and second transverse members 55A, 55B. Alternately, or in addition therewith, the first and second locking assemblies 70A, 70B may be configured with an expanded diameter to encompass a greater training space encompassed by the arcuate members 30.

Figure 1A:
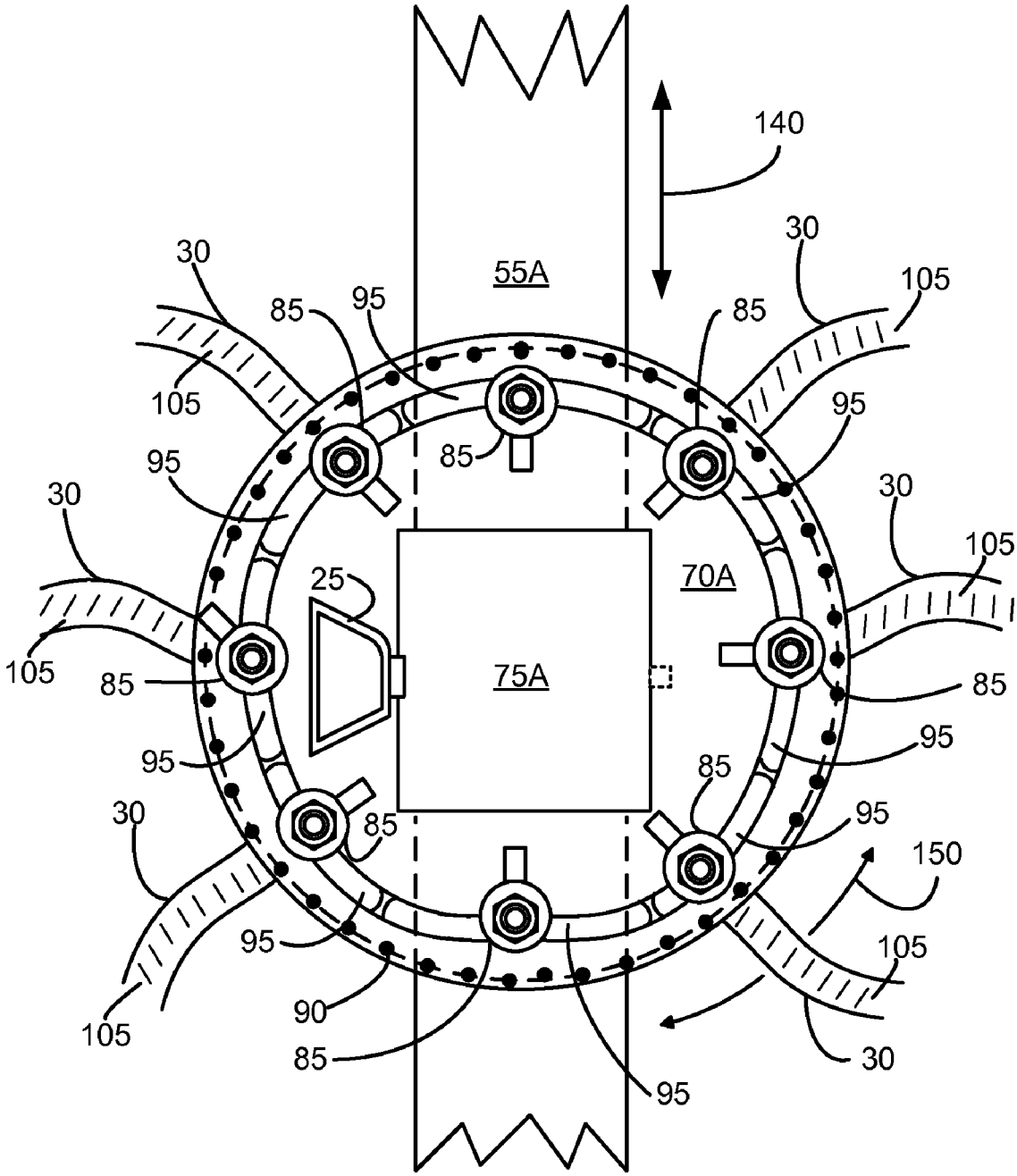
FIG. 1A—depicts a top view of a repositionable locking assembly in accordance with an exemplary embodiment.

Referring to FIG. 1A, a top view of a first locking assembly 70A in accordance with an exemplary embodiment is depicted. The first locking assembly depicted 70A is representative of both the first and second locking assemblies 70A, 70B. Unless otherwise noted, the discussion which follows is directed toward both the first and second locking assemblies 70A, 70B. In an exemplary embodiment, the first locking assembly 70A is constructed from a planar material, preferably cut into a disk shape to form a type of flange. A plurality of arcuate slots 95 are cut into a predominate face of the planar material to allow for individual positioning 150 of the arcuate members 30. The arcuate slots 95 are cut in proximity to an edge of the planar material and dimensioned to transversely receive bolts or pins therethrough. In an exemplary embodiment, the arcuate members 30 are repositionably coupled to the first locking assembly 70A using threaded hand knob assemblies 85. One skilled in the art will appreciate that a multitude of other arrangements may be used to repositionably couple the arcuate members 30 with the first and second locking assemblies 70A, 70B.

In an exemplary embodiment, the first locking assembly 70A includes a slide bracket 75A. The slide bracket 75A may be affixed to the planar portion of the first locking assembly 70A by fasteners, epoxy or by welding. The slide bracket 75A is dimensioned to slidably encompass the transverse member 55A to allow for longitudinal positioning 140 of the first locking assembly 70A along the first transverse member 55A. A locking pin 25 is provided to maintain the first locking assembly 70A in a selected position on a long axis of the first transverse member 55A. As discussed above, the locking pin 25 is configured to engage one of the apertures 80 (FIG. 1) provided in the first transverse member 55A. The locking pin 25 may be oriented to engage the apertures 80 either in parallel or perpendicular to the planar portion of the first locking assembly 70A. In an exemplary embodiment, the first locking assembly 70A may be configured to rotate 150 about a longitudinal axis 120 (FIG. 1) by providing a centered axle or bearing flange on an underside of the slide bracket 75A (not shown.) In this embodiment, axles longitudinally aligned in opposition would be provided on both slide brackets 70A, 70B (FIG. 1).

In an exemplary embodiment, index markings 90 are provided on a planar surface of the first locking assembly 70A for setting of the suitable geometry to perform neuromuscular training.

Figure 1B:
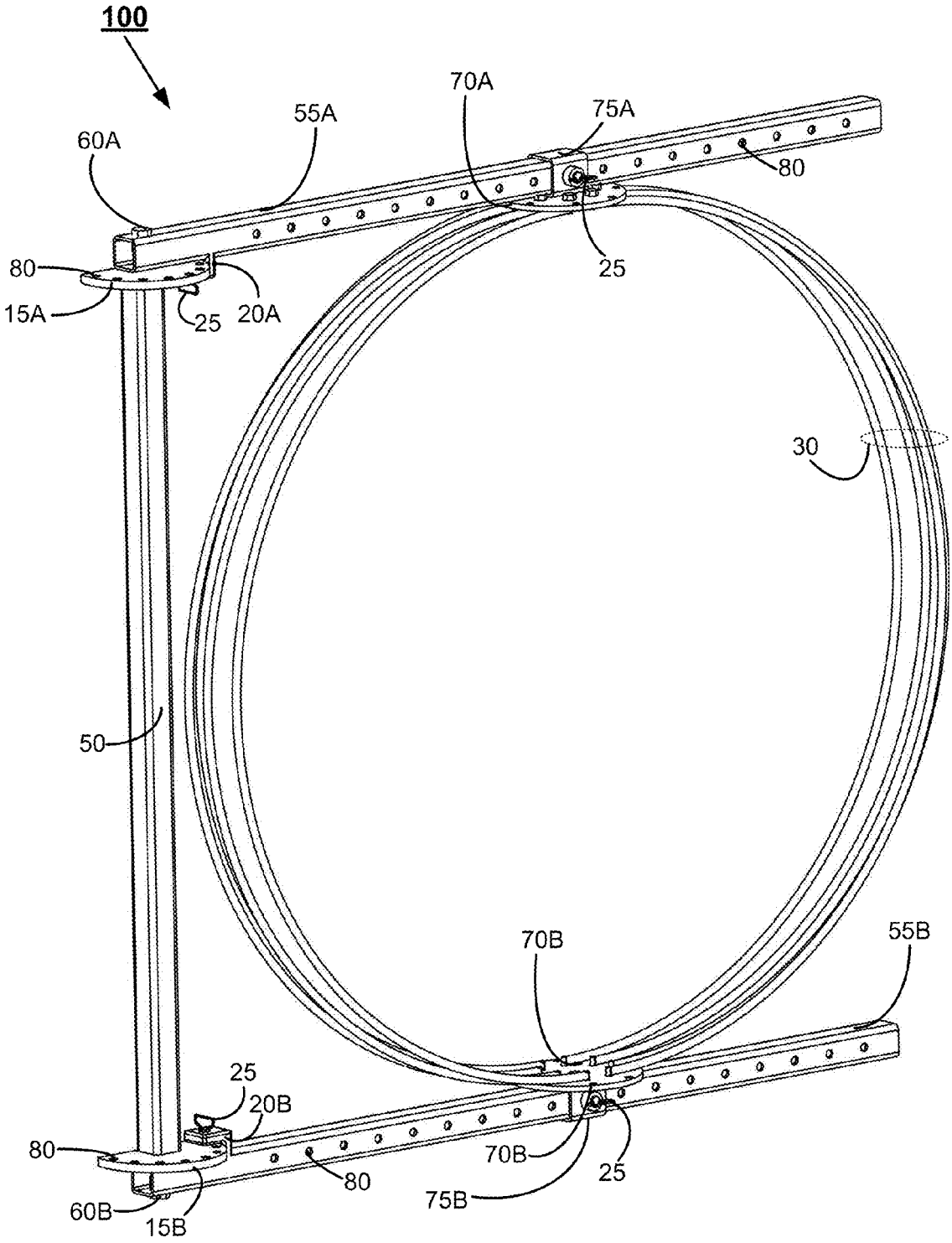
FIG. 1B—depicts an isometric view of a neuromuscular training apparatus in stowed position accordance with an exemplary embodiment.

Referring to FIG. 1B an isometric view of a neuromuscular training apparatus 100 in stowed position is depicted in accordance with an exemplary embodiment. In this exemplary embodiment, the articulate members 30 are rotated so as to be in common plane with the first and second transverse members 55A, 55B and the center support member 50. In addition, the first and second transverse members 55A, 55B are rotated to their end of axial travel about the first and second axles 60A, 60B so as to minimize storage space of the neuromuscular training apparatus 100. For example, the first and second transverse members 55A, 55B and the arcuate members 30 may be rotated to be positioned against a wall (not shown) so as to minimize the overall footprint of the neuromuscular training apparatus 100 when not in use. The connecting members 35 and radial elements 40 may be removed and stored separate from the neuromuscular training apparatus 100.

Figure 2:
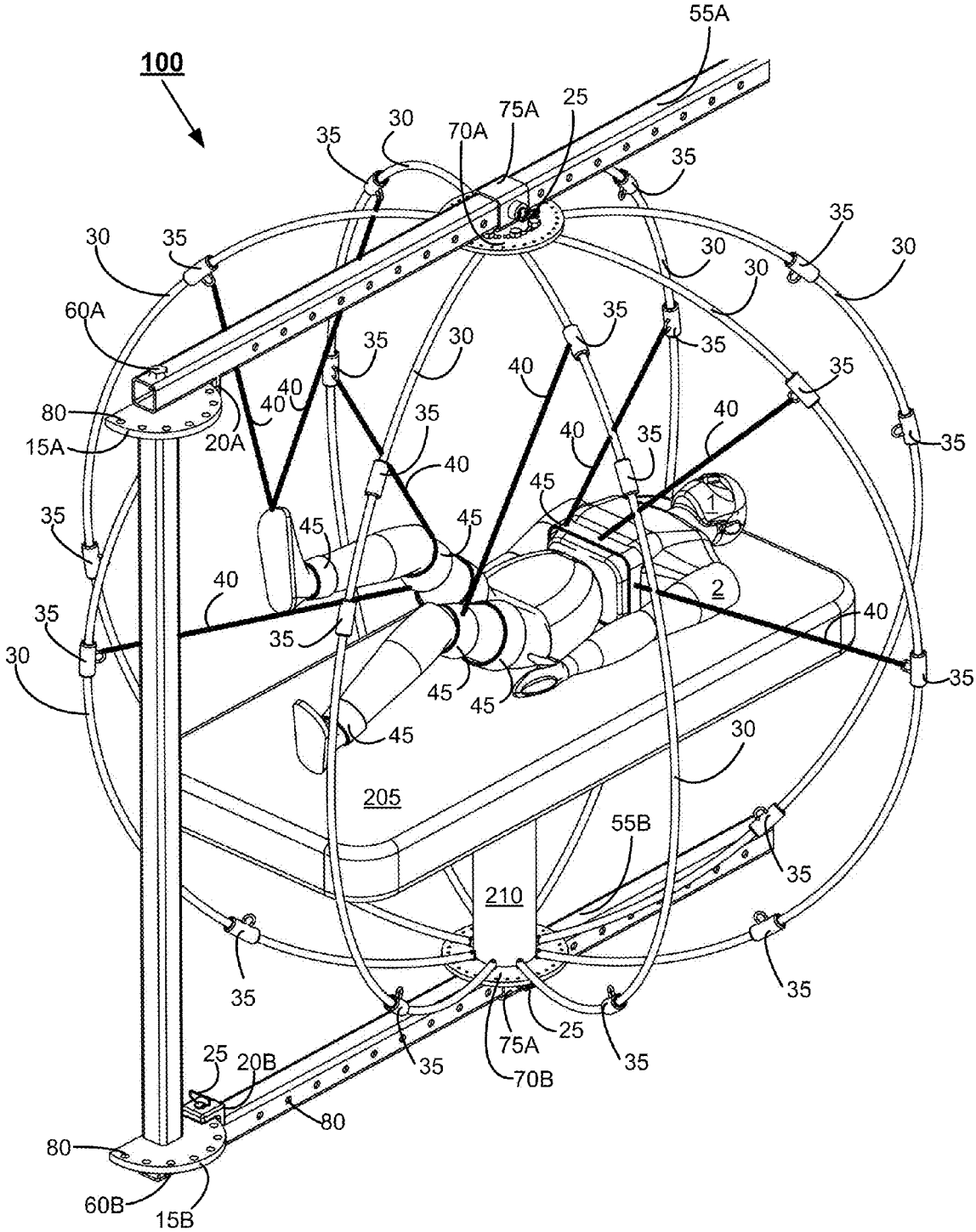
FIG. 2—depicts an isometric view of a first implementation of the neuromuscular training apparatus in accordance with an exemplary embodiment.

Referring to FIG. 2 a isometric view of a first implementation of the neuromuscular training apparatus 100 in accordance with an exemplary embodiment is depicted. In this exemplary embodiment, a subject 1 is disposed in a supine position upon a treatment table 205. The treatment table 205 is supported by a column 210 which engages the second locking assembly 70B. In an exemplary embodiment, the treatment table 205 is configured to allow multi-axis positioning 225 (FIG. 2C) within the treatment space defined by the arcuate members 30. For exemplary purposes, the subject 1 shown in FIG. 2 is undergoing neuromuscular training treatment for an athletic injury to articulations of the pelvis region. Injuries to this part of the human anatomy are traditionally difficult to treat using conventional gym equipment due to the multitude of muscle groups, connective and/or cartilaginous tissues, fascia and articulations present. In this exemplary embodiment, the subject 1 has a plurality of radial elements 40 connected to various portions of the body unit 2. Some of the radial elements 40 are non-resilient in order to retain the body unit 2 in a suitable geometry for treating the pelvic region. The remainder of the radial elements 40 are configured to provide a bias force at an oblique angle across the abdominal region of the subject 1.

Figure 2A:
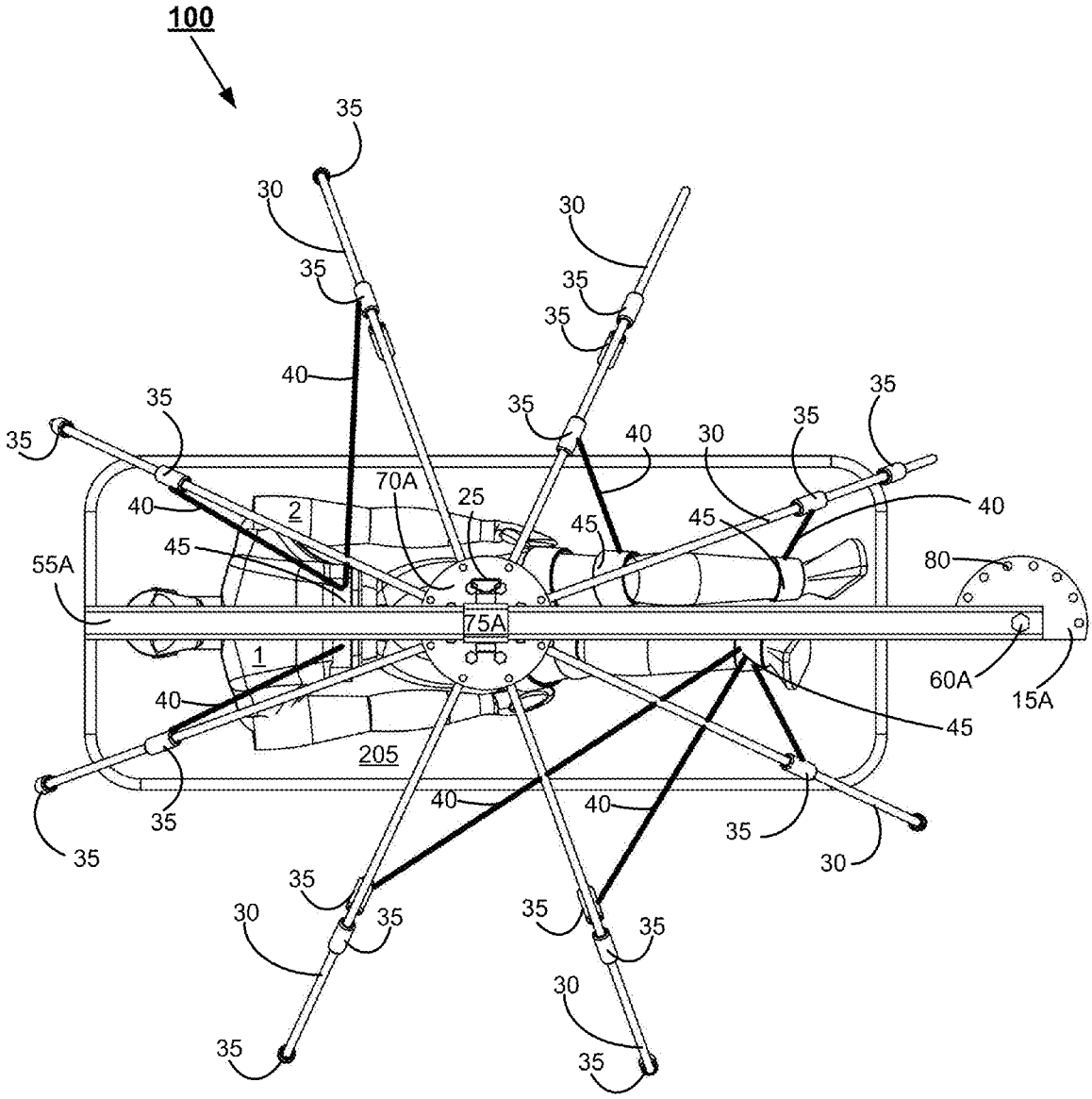
FIG. 2A—depicts a top view of the first implementation of the neuromuscular training apparatus in accordance with an exemplary embodiment.

Referring to FIG. 2A a top view of the first implementation of the neuromuscular training apparatus 100 in accordance with an exemplary embodiment is depicted. In this embodiment, the arcuate members 30 are shown uniformly spaced about the subject 1 and treatment table 205. However, uniform spacing is not required as each of the arcuate members 30 may be independently positioned 150 (FIG. 1A) to establish the suitable geometry Likewise, each of the connecting members 35 may be independently positioned 160, 165 (FIG. 1) about the arcuate members 30.

Figure 2B:
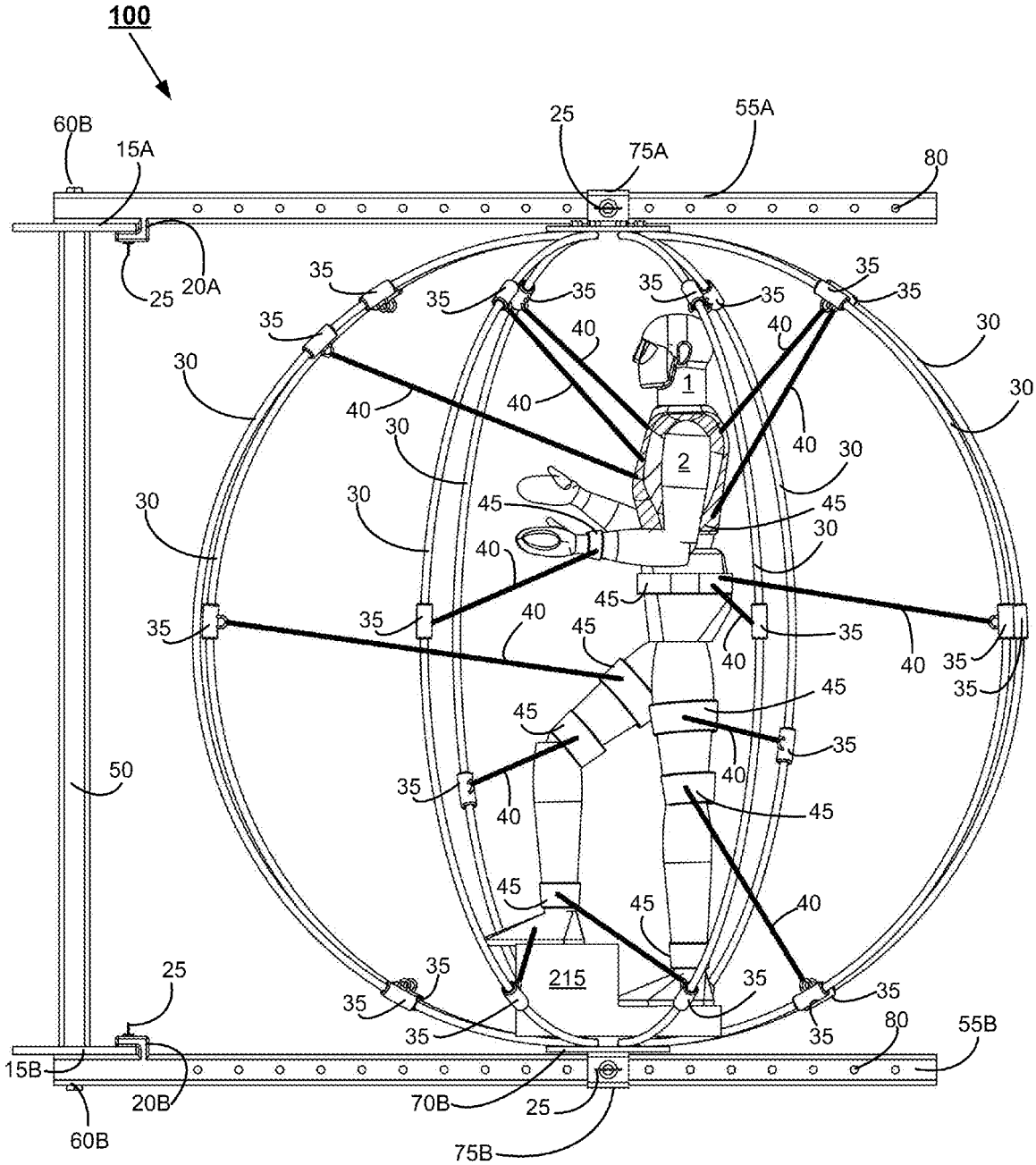
FIG. 2B—depicts a side view of a second implementation of the neuromuscular training apparatus in accordance with an exemplary embodiment.

Referring to FIG. 2B a side view of a second implementation of the neuromuscular training apparatus 100 in accordance with an exemplary embodiment is depicted. In this embodiment, the subject 1 is shown ascending stair-steps 215 in order to rehabilitate an injury to the right upper and lower extremity or body unit 2. The connecting members 35 and radial elements 40 are configured to provide stability, support and exertion of a predetermined bias force on the body unit 2 to accomplish the neuromuscular training.

Figure 2C:
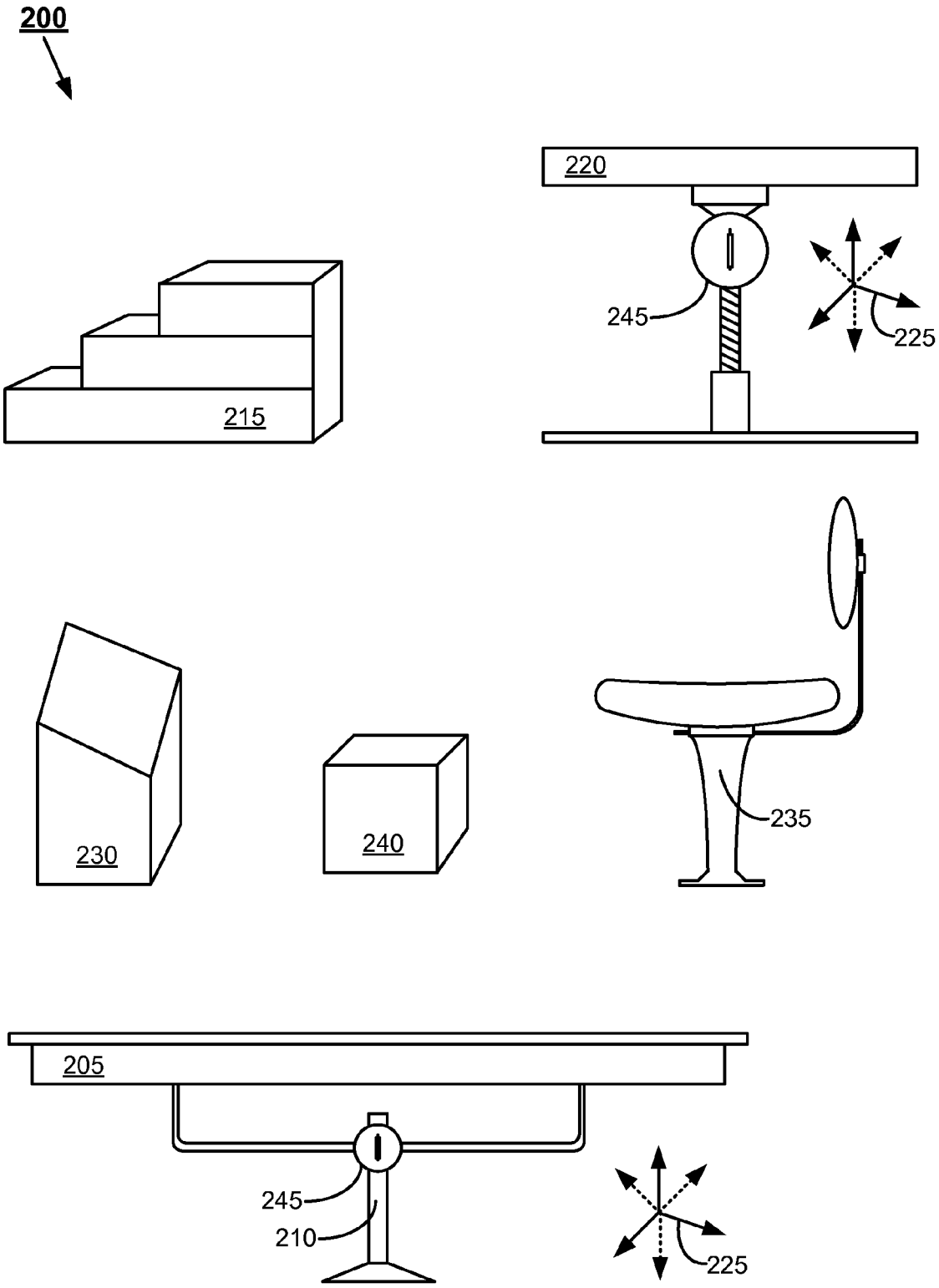
FIG. 2C—depicts various objects used to perform neuromuscular training in accordance with various exemplary embodiments.

Referring to FIG. 2C various objects 200 may be used to perform neuromuscular training with the apparatus 100 in accordance with the various exemplary embodiments is depicted. As briefly discussed above, a treatment table 205 may be placed within the neuromuscular training apparatus 100 (FIG. 1). The treatment table 205 is supported by a column 210. In an exemplary embodiment, the treatment table 205 is pivotally coupled to the column 210 with a locking universal joint 240. The universal joint 240 allows the treatment table to be pivoted in multiple axes 225. In an exemplary embodiment, one or more stair steps 215 may be provided in order to provide neuromuscular training on a body unit which is required to negotiate (ascend and/or descend) stair steps.

In an exemplary embodiment, an adjustable platform 220 may be used to provide neuromuscular training on a body unit 2 (FIG. 1) which articulates from the trunk of the body. In an exemplary embodiment, the adjustable platform 220 includes a locking universal joint 240 which allows the adjustable platform 220 to be pivoted in multiple axes 225. In addition, the adjustable platform 220 may be raised or lowered in order to provide a suitable geometry to perform neuromuscular training of an extremity.

In an exemplary embodiment, a block 230 having a tilted planar surface may be provided in order to provide neuromuscular training on a body unit. The block 230 may be oriented to provide an ascending, descending or an oblique angle suitable for load-bearing of an extremity of the subject 1 (FIG. 1). The use of the various objects is optional to exercise a particular body unit 2 (FIG. 1).

In an exemplary embodiment, a chair 235 may be provided in order to provide neuromuscular training on a body unit. For example, the chair 235 may be used to improve posture, strengthen back muscles and/or for treatment of a back injury.

In various embodiments, each of the objects 205, 210, 215, 220, 230 is configured to be easily installed and removed from the neuromuscular training apparatus 100 as is necessary to provide neuromuscular training on a particular body unit. This may be accomplished using latches, clamps and/or fasteners (not shown).

Figure 3:
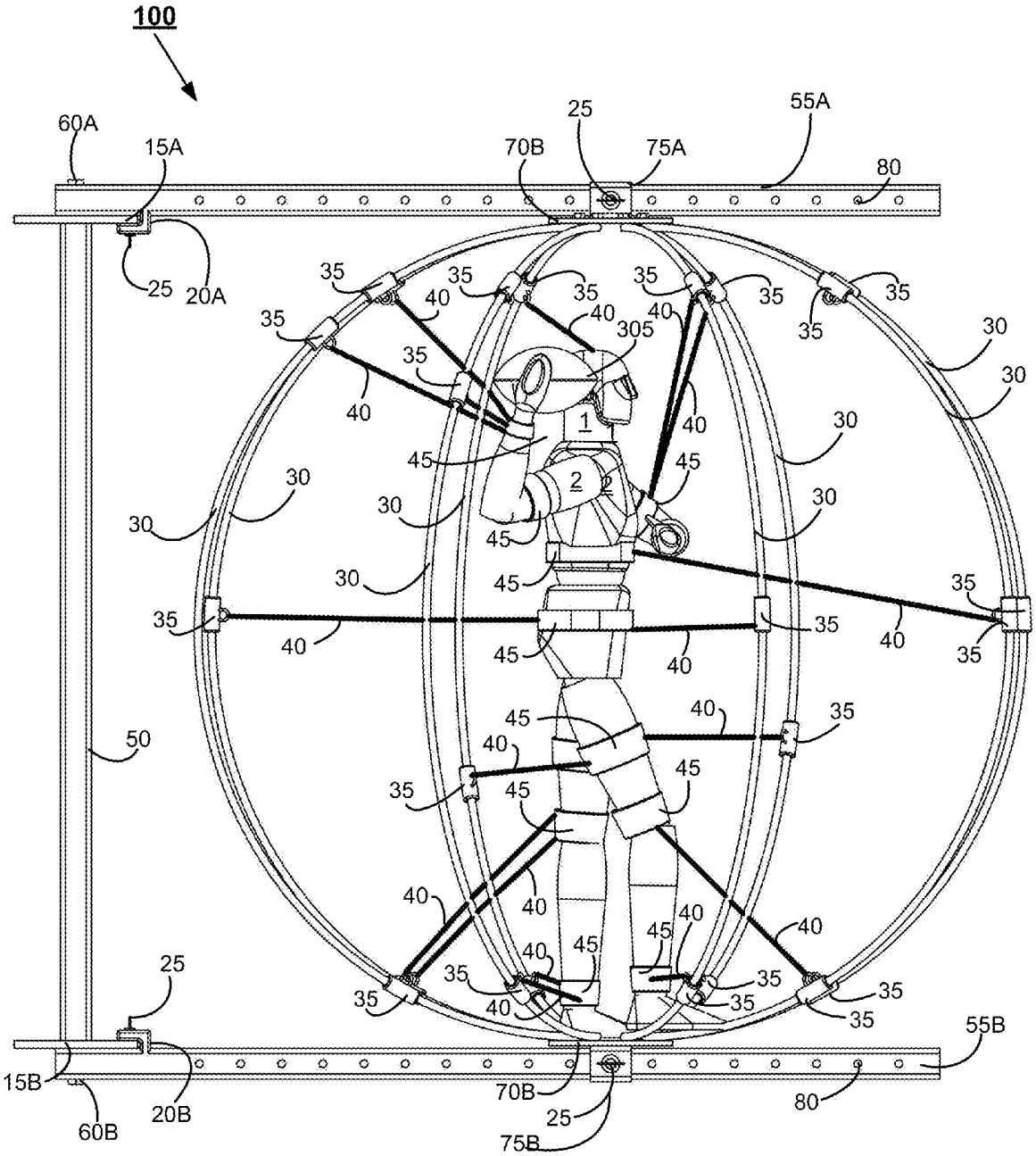
FIG. 3—depicts a side view of a third implementation of the neuromuscular training apparatus in accordance with an exemplary embodiment.

Referring to FIG. 3 a side view of a third implementation of the neuromuscular training apparatus 100 in accordance with various exemplary embodiment is depicted. In this embodiment, the subject 1 is undergoing neuromuscular training in order to develop the proper grip, body position and/or throwing motion of a piece of athletic equipment, i.e., a football 305. The arcuate members 30, connecting members 35 and radial elements 40 are configured to provide a suitable geometry by applying bias forces to one or more body units 2 using the slings 45.

Figure 3A:
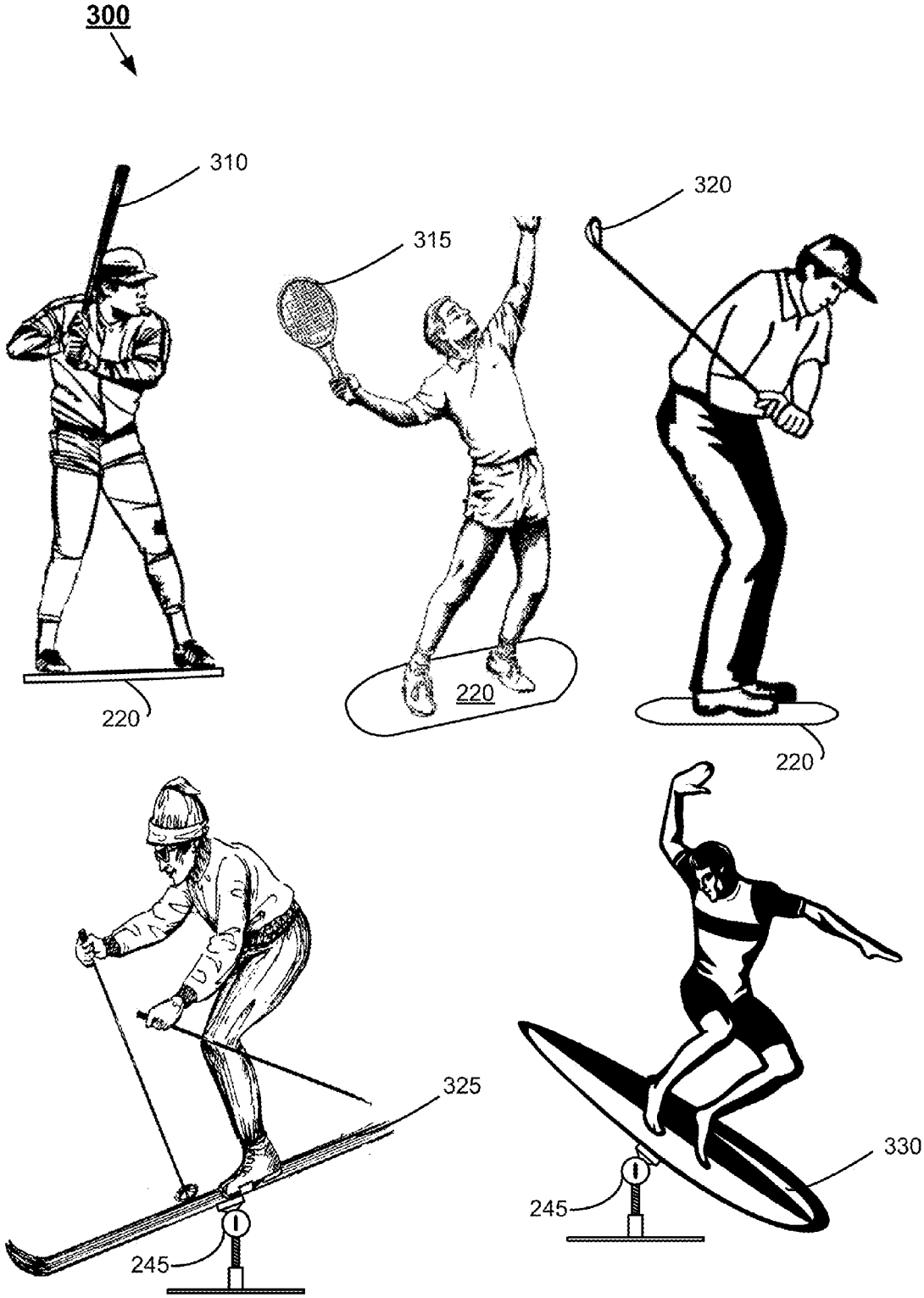
FIG. 3A—depicts a plurality of athletic activities and athletic equipment particularly suited for usage of the neuromuscular training apparatus in accordance with the various exemplary embodiments.

Referring to FIG. 3A, a plurality of other athletic activities and/or athletic equipment particularly suited for usage of the neuromuscular training apparatus 100 in accordance with an exemplary embodiments is depicted. For example, swinging a baseball bat 310, serving a tennis ball with a tennis racket 315, and swinging a golf club 320 all require proper body positions, torso twisting motions and extremity movements needed to properly engage a ball. However, the range of motions and/or body positions required to properly engage a ball are distinct from one another Likewise, snow or water skiing 325 and surfboarding 330 require distinctive stances, balancing and range of motions which are more focused on the lower torso and lower extremities and are distinctly different from primarily upper torso motions of hitting a ball.

Referring back to FIG. 1, the portion of the body unit 2 of the subject 1 is situated within the neuromuscular training apparatus 100. Slings 45 are then placed on the body unit 2 to receive neuromuscular training. The arcuate members 30 and connecting members 35 are then positioned in order to obtain a suitable geometry for performing neuromuscular training. For repeatability, the initial positions of the arcuate members 30 and/or connecting members 35 may be recorded in a log using the index marks 90, 105 provided on the first and second locking assemblies and arcuate members 70A, 70B, 30.

Figure 4:
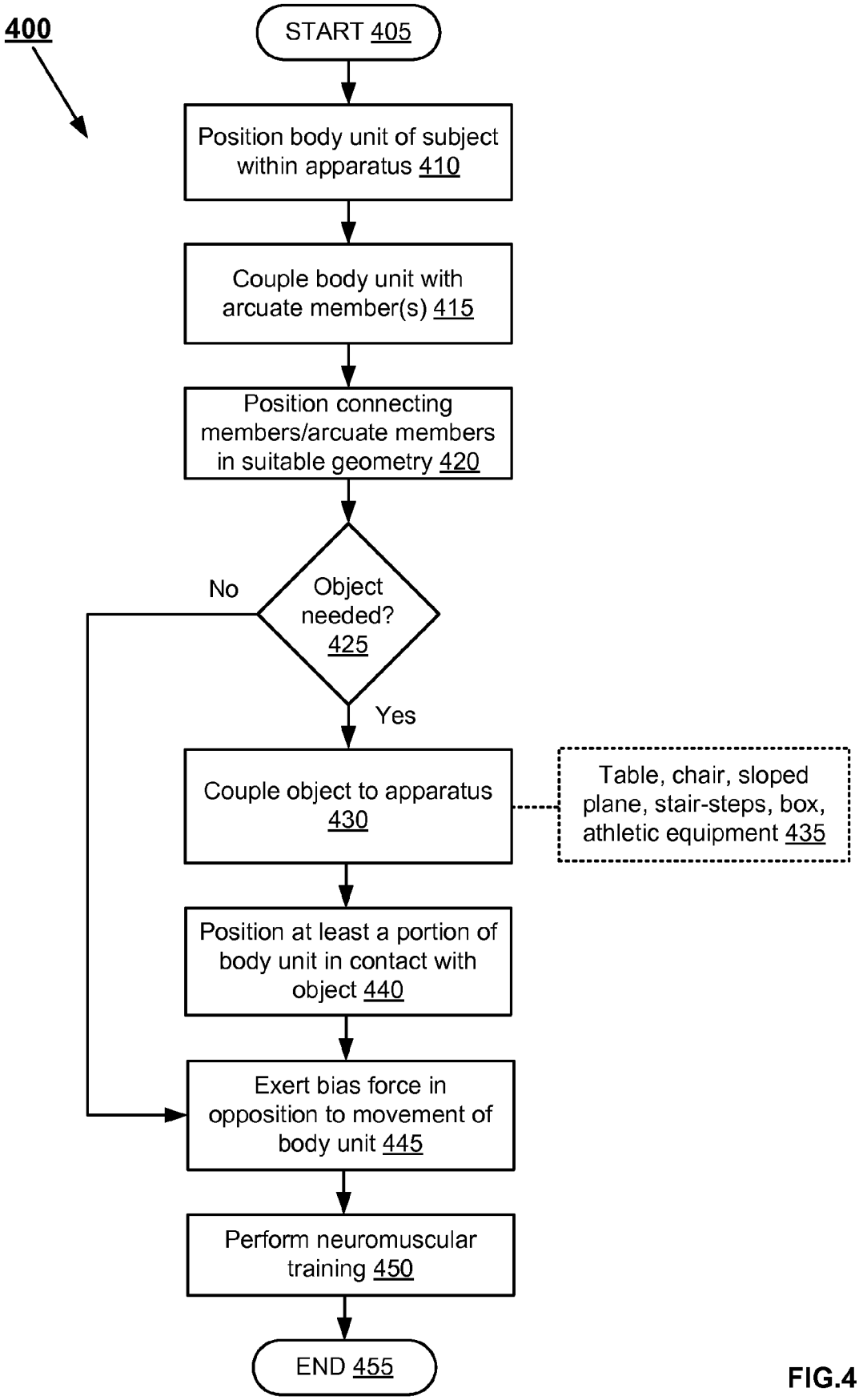
FIG. 4—depicts a method for performing neuromuscular training using the apparatus in accordance with the various exemplary embodiments.

Referring to FIG. 4 a method 400 for performing neuromuscular training using the neuromuscular training apparatus 100 in accordance with the various exemplary embodiments is depicted. In an exemplary embodiment, the method 400 is begun 405 by positioning the body unit 2 of a subject 1 (FIG. 1) within the neuromuscular training apparatus 410. Slings 45 (FIG. 1) are then are applied to the body unit 2 (FIG. 1) in which neuromuscular training is to be accomplished. Radial elements 40 are then connected with the slings 45 (FIG. 1). The radial elements 40 are then connected with the arcuate members 30 using the connecting members 35 which couples the body unit 2 of the subject 1 with the arcuate members 415. The arcuate members 30 and/or connecting members 35 are then positioned to provide a suitable geometry 420 to perform neuromuscular integration. Where necessary to maintain the suitable geometry, a portion of the radial members 40 may be configured to retain a portion of the body unit 2. In this situation, the retaining portion of the radial elements 40 are constructed from a limp cordlike material (e.g., nylon, Dacron, Kevlar, cotton, etc.). Likewise, where necessary to maintain the suitable geometry, a portion of the radial members 40 may be configured to inhibit movement of a portion of the body unit 2. In this situation, the inhibiting portion of the radial elements 40 are constructed from a generally rigid rod-like material (e.g., PVC, ABS, acrylic, fiberglass, polycarbonate, graphite composites, etc.). The remainder of the radial elements 40 are tensile in nature and are configured to exert a bias force on the body unit 2 when undergoing neuromuscular training. The bias force may be used to either restrain or assist movement of the body unit 2.

If an object is needed to perform neuromuscular training 425, the selected object (FIG. 2) is coupled to the neuromuscular training apparatus 430. The object 200 (FIG. 2) may be any of a table, stair-steps, an adjustable platform, a sloped plane, a chair, a box and/or a piece of athletic equipment 435. When the object 300 is a piece of athletic equipment 300, the suitable geometry exerts the bias force on the body unit 2 which simulates a musculoskeletal position for use of the particular piece of athletic equipment 300. The object is then configured such that at least a portion of the body unit 2 is in contact with the object 440. If an object is not needed 425 or after the object has been properly configured, the proper bias force is then applied to either oppose and/or assist movement of the body unit 445. In an exemplary embodiment, the bias force is exerted at an angle perpendicular to joint. Once the proper bias force has been established, the subject 1 (FIG. 1) performs neuromuscular training until the exercise regimen is completed which ends the method 455.

The neuromuscular training apparatus 100 (FIG. 1) can be used for the hand, foot, shoulder and/or the entire body depending on the set suitable geometry and the appropriately scaled dimensions of the apparatus 100. The neuromuscular training apparatus 100 may used with a body unit disposed in a free space defined by the arcuate members or in weight bearing situation. Neuromuscular training can be accomplished in a sitting, standing, lying on the sides, prone, supine, rotating, and or any combination of position of the body unit.

In other inventive aspects, the neuromuscular training apparatus 100 can be configured to provide proprioceptive training of a football player for blocking through a multidimensional line; develop a professional swing of a golf club, or picking up a package with proper posture to avoid occupational injuries. All of these suitable geometries can be accomplished with slings 45 disposed about the foot, lower leg, above the knee, waist, trunk, shoulders and hands. The radial elements 40 can be configured for resistive training, at various angles. The neuromuscular training apparatus 100 can be configured to work a few muscles, to dozens, with attachment of slings and radial elements 40 which allow for immediate resistance, in an opposite direction of motion. Slow, medium, fast, or very high velocity training can be accomplished. Working strength, endurance, power, and speed radial elements 40 allow progressions of difficulty, and specificity of training.

The various exemplary inventive embodiments described herein are intended to be merely illustrative of the principles underlying the inventive concept. It is therefore contemplated that various modifications of the disclosed embodiments will, without departing from the inventive spirit and scope, be apparent to persons of ordinary skill in the art. They are not intended to limit the various exemplary inventive embodiments to any precise form described. In particular, it is contemplated that the neuromuscular training apparatus and related components may be constructed from any suitable material. All of the various components and structures described herein may be scaled to accommodate a particular design objective. No specific limitation is intended to a particular construction material, order or sequence described. Other variations and inventive embodiments are possible in light of above teachings, and it is not intended that this Detailed Description limit the inventive scope, but rather by the Claims following herein.

What is claimed:

1. An neuromuscular training apparatus comprising:

a fixture having pivotally coupled thereto a plurality of repositionable arcuate members;

the plurality of repositionable arcuate members configured to maintain a plurality of radial elements in a suitable geometry for exerting a bias force on a body unit;

the body unit being that of a user;

the suitable geometry comprising at least three arcuate members simultaneously coupled with the body unit;

the plurality of radial elements comprising elastomeric cords;

at least some of the plurality of radial elements, which when coupled with one or more of the plurality of arcuate members and attached with the body unit, exerts the bias force in/opposition to movement of the body unit;

wherein the plurality of repositionable arcuate members pivot about a common axial centerline of the fixture to form a spherical framework from which the plurality of radial elements are simultaneously coupled with the body unit undergoing neuromuscular training.

2. The neuromuscular training apparatus of Claim 1 wherein the fixture comprises:

a longitudinal member;

a first transverse member coupled to one end of the longitudinal member;

a second transverse member coupled to an opposite end of the longitudinal member, the second transverse member disposed in a parallel spaced relationship with the first transverse member.

3. The neuromuscular training apparatus of Claim 1 wherein the radial elements are coupled to the plurality of arcuate members with connecting members.

4. The neuromuscular training apparatus of claim 2 wherein the fixture further comprises:

first and second locking assemblies configured to repositionably maintain opposing ends of the plurality of repositionable arcuate members in the suitable geometry.

5. The neuromuscular training apparatus of claim 4 wherein the first locking and second locking assemblies are repositionably coupled to the first and second transverse members respectively.

6. The neuromuscular training apparatus of claim 4 wherein at least one of the plurality of repositionable arcuate members, the first and second transverse members, or the first and second locking members include index markings for setting of the suitable geometry.

7. The neuromuscular training apparatus of claim 4 wherein each of the plurality of arcuate members form a semi-circular frame which spans the parallel spaced relationship between the first and second locking assemblies.

8. An neuromuscular training apparatus comprising:

a fixture having pivotally coupled thereto at least three repositionable arcuate members;

the repositionable arcuate members configured to maintain a plurality of radial elements in a suitable geometry for exerting a bias force on a body unit;

the body unit being that of a user;

the suitable geometry comprising at least three radial elements simultaneously coupled with the body unit and with the at least three repositionable arcuate members;

at least some of the radial elements, which when coupled with one or more of the arcuate members and the body unit exert the bias force in opposition to movement of the body unit;

at least some of the radial elements comprising elastomeric cords;

a plurality of connecting members configured to couple the radial elements with the at least three arcuate members;

wherein at least one radial element which when coupled with at least one of the at least three repositionable arcuate members and attached with the body unit is configured to provide the bias force in opposition to movement of a joint, a muscle, a bone, cartilaginous tissue or a tendon associated with the body unit;

wherein the plurality of repositionable arcuate members pivot about a common axial centerline of the fixture to form a spherical framework; the spherical framework defining a spherical volume configurable to surround the body unit at three different positions relative to the body unit.

9. The neuromuscular training apparatus of claim 8 wherein each of the plurality of connecting members is longitudinally repositionable when coupled with one of the arcuate members.

10. The neuromuscular training apparatus of claim 8 wherein at least some of the arcuate members are individually repositionable to form the spherical framework.

11. The neuromuscular training apparatus of claim 8 wherein at least some of the plurality of radial elements are further configured to promote movement of the body unit in a range of motion compatible with the suitable geometry.

12. The neuromuscular training apparatus of claim 8 wherein at least some of the plurality of radial elements are further configured to limit movement of the body unit in a range of motion compatible with the suitable geometry.

13. The neuromuscular training apparatus of claim 8 further comprising a sling coupled to an end of each of the plurality of radial elements, the sling dimensioned to receive at least a portion of the body unit in which the bias force is exerted.

14. The neuromuscular training apparatus of claim 8 wherein the suitable geometry causes the bias force to be exerted generally at an angle perpendicular with the body unit.

15. The neuromuscular training apparatus of claim 8 wherein the bias force is multi-axial and exerted as a vector sum to the body unit such that the body unit is confined to the predetermined range of motion.

16. The neuromuscular training apparatus of claim 8 further comprising an object which contacts the body at least during exertion of the bias force.

17. The neuromuscular training apparatus of claim 16 wherein the object is selected from the group consisting of a table, a chair, a sloped plane, stair-steps, a box and a piece of sporting equipment.

18. The neuromuscular training apparatus of claim 17 wherein the table is a multi -axis tilt table.

19. A method of using the neuromuscular training apparatus of claim 1 comprising:

coupling the body unit with at least one of the plurality of arcuate members;

positioning the radial elements in the suitable geometry for exerting the bias force on the body unit;

exerting the bias force in opposition to movement of the body unit.

20. The method of claim 19 wherein the suitable geometry exerts the bias force on the body unit for simulating one or more musculoskeletal positions associated with a particular piece of sporting equipment.

21. The method of claim 19 further comprising:

disposing at least a portion of the body unit in contact with an object before exerting the bias force.

22. The method of claim 21 wherein the object is selected from the group consisting of a table, a chair, a sloped plane, stair-steps, a box and a piece of sporting equipment.

* * * * *